United States Patent [19]

Saad

[11] Patent Number: 4,646,039

[45] Date of Patent: Feb. 24, 1987

[54] LOW PASS FILTERS WITH FINITE TRANSMISSION ZEROS IN EVANESCENT MODES

[75] Inventor: Abdelmegid K. Saad, Cambridge, Canada

[73] Assignee: Com Dev Ltd., Cambridge, Canada

[21] Appl. No.: 667,822

[22] Filed: Nov. 2, 1984

[30] Foreign Application Priority Data

May 28, 1984 [CA] Canada ..... 455286

[51] Int. Cl.[4] ..... H01P 1/211

[52] U.S. Cl. ..... 333/210; 333/248

[58] Field of Search ..... 333/210, 211, 212, 209, 333/208, 202, 227, 230, 248

[56] References Cited

U.S. PATENT DOCUMENTS 3,885,118 5/1975 Valtersson ..... 333/211 X
3,949,327 4/1976 Chappell ..... 333/210
4,028,650 7/1977 Konishi et al. ..... 333/210
4,467,294 8/1984 Janky et al. ..... 333/208 X

FOREIGN PATENT DOCUMENTS 1566027 7/1970 Fed. Rep. of Germany ..... 333/208
0104501 6/1983 Japan ..... 333/208

*Primary Examiner*—Eugene R. LaRoche
*Assistant Examiner*—Benny T. Lee
*Attorney, Agent, or Firm*—Daryl W. Schnurr

[57] ABSTRACT

A waveguide lowpass filter operates in at least two evanescent modes. The filter has successive ridges with a space between said ridges. The ridges are associated with parallel capacitance and a space between them is associated with series inductance in the $TE_{10}$ mode. Each ridge is top-loaded so that series capacitance can occur in a $TM_{11}$ mode in parallel to said series inductance. The filters of the present invention can be made smaller than previous evanescent lowpass filters and can achieve improved results.

10 Claims, 19 Drawing Figures

LOW PASS FILTERS WITH FINITE TRANSMISSION ZEROS IN EVANESCENT MODES

BACKGROUND OF THE INVENTION

1. Field of the Invention

This invention relates to lowpass harmonic filters and, in particular, to lowpass filters that are used in output circuits of communications satellites.

2. Description of the Prior Art

It is known to have lowpass harmonic filters. However, previous lowpass filters utilizing an evanescent mode technique do not have high power handling capability; they do not operate in more than one mode; they cannot be made to realize a filter response with finite transmission zeros; they are large or heavy; or, they do not operate with series capacitance in parallel to series inductance.

It is an object of the present invention to provide a waveguide lowpass filter that operates in at least two evanescent modes and can realize a filter response with finite transmission zeros.

SUMMARY OF THE INVENTION

In accordance with the present invention, a waveguide lowpass filter operates in at least two evanescent modes. The filter has a waveguide with a single row of successive ridges along a length of the waveguide with spaces between successive ridges. The ridges are associated with parallel capacitance and the spaces are associated with series inductance in one mode. Each ridge has a top-loading mounted thereon so that series capacitance can occur in a different mode in parallel to said series inductance between the top-loading on successive ridges.

Preferably, the filter operates in $TE_{10}$ and $TM_{11}$ evanescent modes and the series inductance and parallel capacitance occurs in the $TE_{10}$ mode with the series capacitance occurring in the $TM_{11}$ mode in parallel to said series inductance.

BRIEF DESCRIPTION OF THE DRAWINGS

In drawings which illustrate a preferred embodiment of the invention.

DESCRIPTION OF A PREFERRED EMBODIMENT

Figure 1:
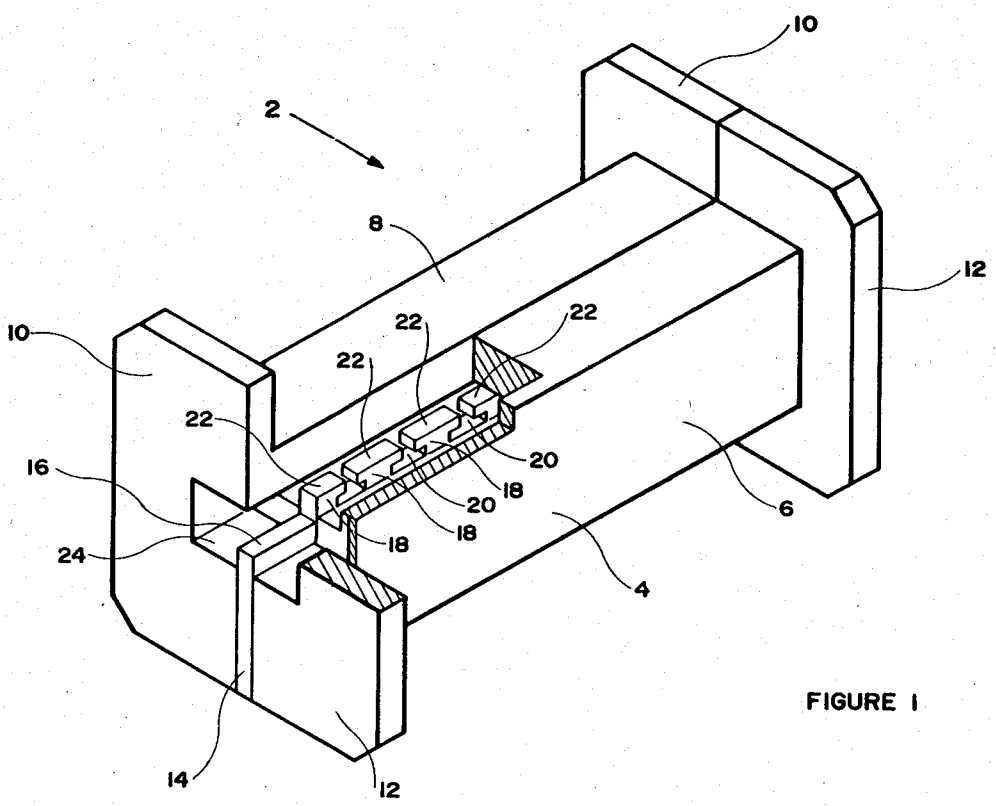
FIG. 1 is a perspective view of a filter of the present invention with part of a housing removed to expose successive top-loaded ridges.
Figure 2:
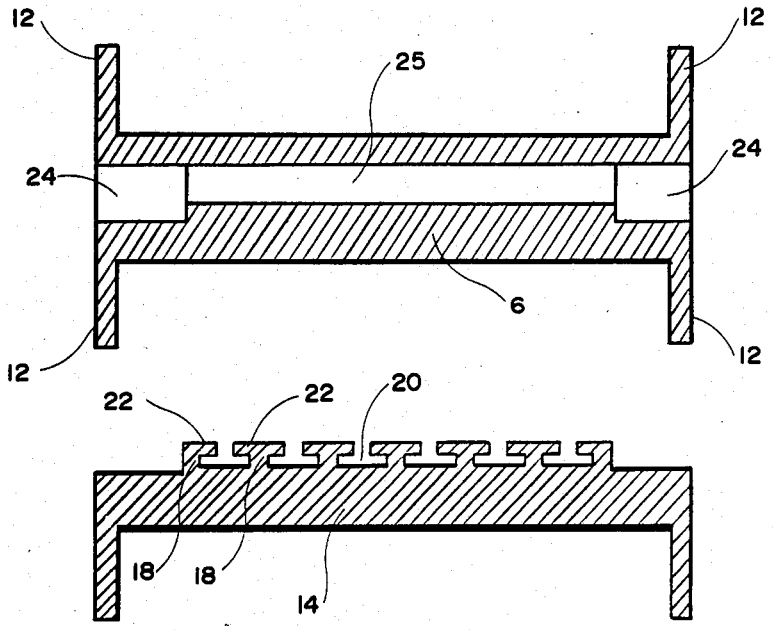
FIG. 2 is a sectional side view of a centre plate and part of the housing of said filter.
Figure 3:
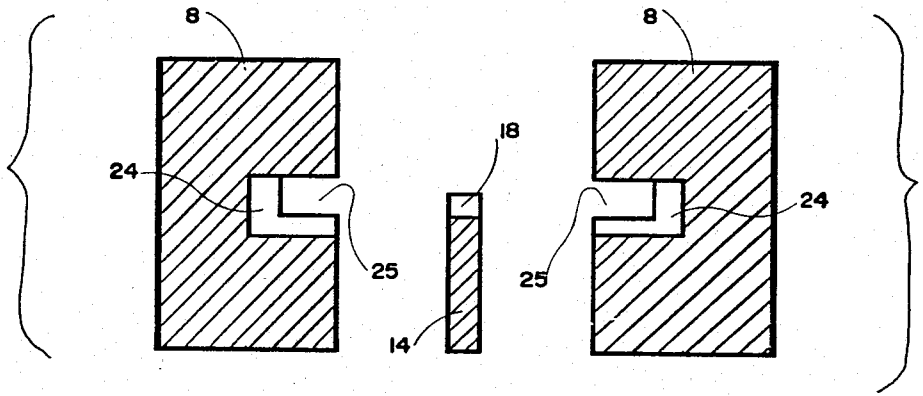
FIG. 3 is a sectional end view of the centre plate and said housing spaced apart from one another.

Referring to FIG. 1 in greater detail, a filter 2 has a housing 4 which can be split into two identical sections 6, 8. The housing 4 is the waveguide of the filter. The sections 6, 8 have end portions 10, 12 respectively. Between the two sections 6, 8, there is fitted a plate 14, said plate having an upper surface 16 with successive ridges 18 mounted thereon and located along a length of the filter 2. Spaces 20 are located between said ridges. The ridges 18 have a top-loading 22 that gives most of the ridges a T-shaped cross-section when viewed from either side. The first ridge 18 has an L-shaped cross-section when viewed from either side. A single ridge quarter-wave transformer is located in a section 24. The sections 6, 8 are simply half-sections of the housing 4 and are designed to fit together with the plate 14 in between to form the filter 2. The ridges 18 of the plate 14 are located in a waveguide section 25 of the sections 6, 8. In FIG. 2, there is shown a sectional side view of the plate 14 and section 6. The waveguide section 25 is a space formed into each of the sections 6, 8. It can be seen that the first ridge 18 and last ridge 18 have an L-shape when viewed from either side and that the ridges 18 located between said first and last ridges have a T-shape when viewed from either side. In FIG. 3, there is shown a sectional end view of the plate 14 and two sections 6, 8. It can be seen that the ridges 18 are in a straight line along the length of said waveguide.

Figure 4:
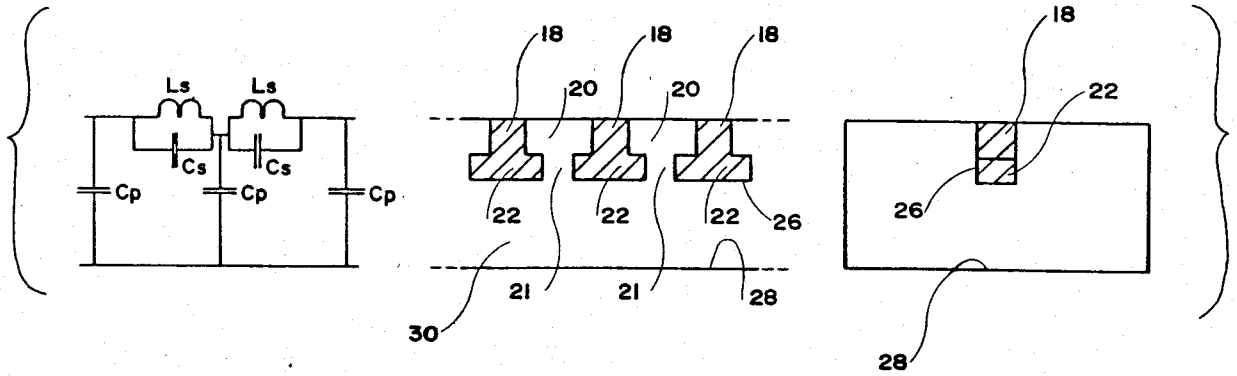
FIG. 4 is a schematic view of three top-loaded ridges and equivalent circuit diagram.
Figure 5B:
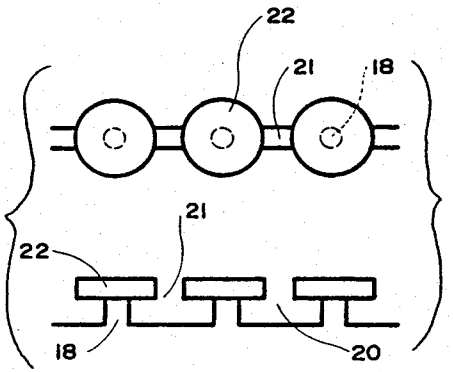
FIGS. 5(*a*) to 5(*e*) show variations in the manner in which ridges can be top-loaded.
Figure 5E:
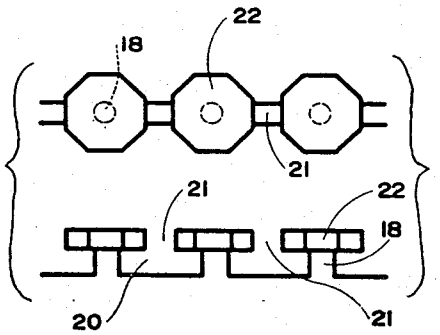
Figure 5C:
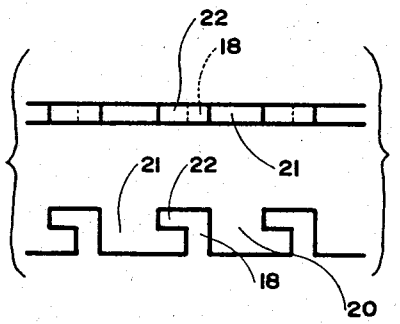
Figure 5A:
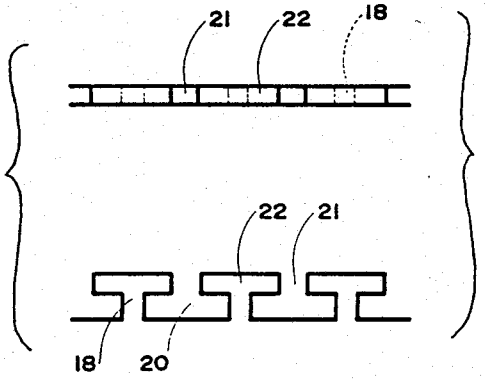
Figure 5D:
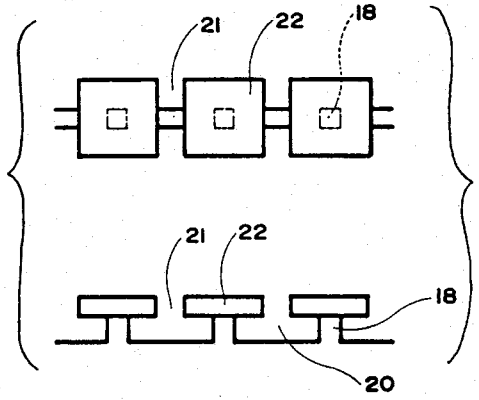

In FIG. 4, there are shown three successive ridges 18 with spaces 20 located between said ridges. The ridges 18 have the top-loading 22 thereon to give them a T-shape when viewed from either side. As can be seen from an end view of said ridges, the ridges 18 are parallel to one another. The equivalent circuit shows that the ridges 18 are associated with parallel capacitance $C_p$ between a top surface 26 of each ridge 18 and an interior surface 28 of the housing 4. The spaces 20 are associated with series inductance as shown by $L_s$ on the circuit diagram. The top-loading 22 of each ridge 18 extends a sufficient distance towards adjacent ridges 18 so that series capacitance $C_s$ occurs across space 21 of the top-loading 22. The space 21 is smaller than the space 20. If there were no top-loading 22 on the ridges 18, no series capacitance $C_s$ would occur and the filter would operate in a manner similar to that described by Chappell in U.S. Pat. No. 3,949,327 issued in April of 1976 and entitled "Waveguide Low Pass Filters Using Evanescent Mode Inductors".

In FIG. 5, there are shown numerous variations in the types of top-loading that can be used in accordance with the present invention. In general terms, any top-loading that permits series capacitance to occur in parallel to the series inductance can be used with the present invention. The top-loading must be of sufficient size so that capacitance will occur across the space 21 between the top-loading 22 on adjacent ridges 18.

In FIG. 5(*a*), there is shown a top view and a side view of ridges 18 having top-loading 22. It can readily be seen that the ridges have a T-shape when viewed from either side.

In FIG. 5(*b*), there is shown a circular top-loading 22 that also has a T-shape when viewed from either side.

In FIG. 5(*c*), there is shown a top-loading 22 that extends in one direction only from the ridge 18. It can readily be seen that this top-loading 22 causes the ridges 18 to have an L-shape when viewed from either side.

In FIG. 5(*d*), a top-loading 22 has a square shape and a side view is again T-shaped.

In FIG. 5(*e*), the top-loading 22 has an hexagonal shape and a T-shape when viewed from either side.

Various other shapes will be readily apparent to those skilled in the art as being suitable for use in the present invention. For example, antennae could be used as the top-loading 22 to cause series capacitance to occur in parallel with the series inductance.

Figure 6A:
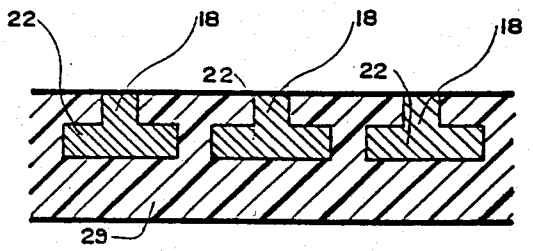
FIGS. 6(*a*), 6(*b*) and 6(*c*) show T-shaped ridges constructed with a fine-line technique.
Figure 6B:
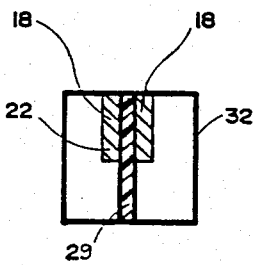
Figure 6C:
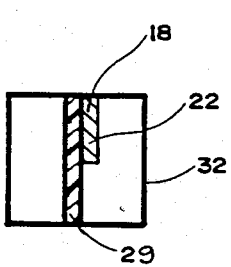
Figure 7A:
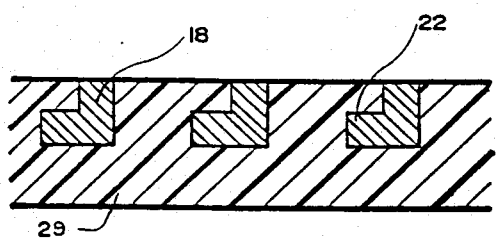
FIGS. 7(*a*), 7(*b*) and 7(*c*) disclose L-shaped ridges constructed in a fin-line technique.
Figure 7B:
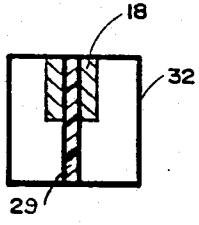
Figure 7C:
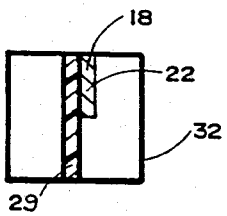

FIG. 6 shows the use of a fin-line technique as discussed by A. M. K. Saad and G. Begemann, in a paper entitled, "Electrical Performance of Fin-Lines of Various Configurations", published in Institute of Electrical Engineering—Microwaves, Optics and Acoustics, Vol. 1, January 1977, pages 81 to 88. That paper is incorporated herein by reference. Fin-line can be described as a rectangular waveguide loaded in an E-plane with a dielectric substrate metallized with a thin layer of copper either from both sides (bilateral fin-line) or from one side (unilateral fin-line). The metallization is shaped to the desired shapes by a photo-etch technique. FIG. 6(*a*) is a sectional side view of ridges 18 with top-loading 22 that has been metallized onto a dielectric substrate 29. FIG. 6(*b*) is an end view of said ridges 18, top-loading 22 and substrate 29 when bilateral fin-line has been utilized. FIG. 6(*c*) is an end view when unilateral fin-line has been used. In FIGS. 6(*b*) and 6(*c*), a waveguide shield 32 surrounds and fin-line ridges 18 and top-loading 22. FIGS. 7(*a*), 7(*b*) and 7(*c*) are essentially the same as FIG. 6 except that the ridges 18 and top-loading 22 are L-shaped rather than T-shaped.

In operation, the filter 2 of the present invention can realize finite transmission zeros in its response in addition to having shunt capacitance or parallel capacitance in a gap 30 between a top surface 26 of each ridge 18 and an interior surface 28 of the housing 4, the filter 2 can excite the evanescent $TE_{10}$ mode in series inductance and parallel capacitance and at the same time excite the evanescent $TM_{11}$ mode in series capacitance in parallel to the series inductance (see FIG. 4). The filter 2 can realize finite transmission zeros and therefore a quasielliptic response. A sharper filter cut-off frequency can be achieved with a lesser number of sections than in the case of previous all-pole Chebyshev or Zolotarev lowpass filter realization. This results in a reduced filter length and reduced weight and size of the filter is very important in satellite applications. The filter can be designed for different power handling capabilities in a vacuum environment by adjusting the width of the gap 30 as discussed by R. Woo and A. Ishinaru in their paper, "A Similarity Principle for Multipacting Discharges" published in the Journal of Applied Physics, Vol. 38, No. 13, December, 1967, pages 5240–5244. The isolation in the stopband of the filter will be less for high power handling capability and to at least the third harmonic for low and medium power handling capability. With the growing number of satellite and frequency bands, it is becoming more important to provide high isolation all the way from the receive band to third harmonic in order to control various emissions and minimize interference with other satellite systems.

Figure 8:
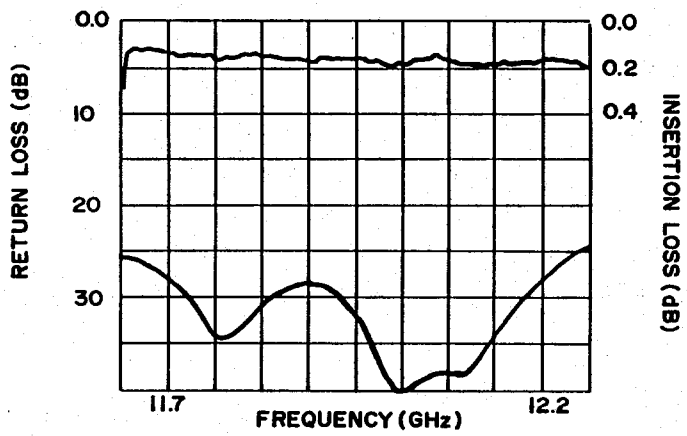
FIG. 8 is a measured passband response for a filter constructed in accordance with the present invention.
Figure 9:
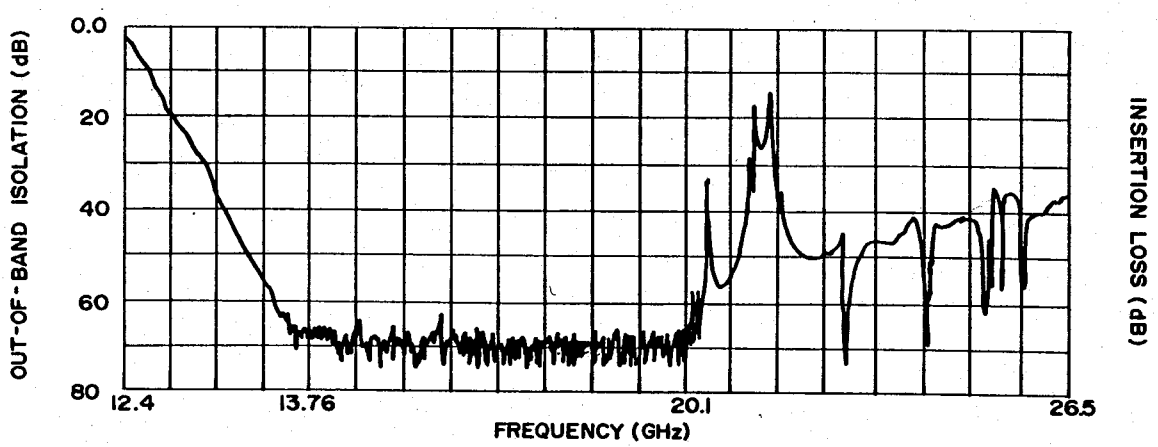
FIG. 9 is a measured out-of-band response for a filter constructed in accordance with the present invention.

In order to obtain the results shown in FIGS. 8 and 9, a filter was designed in accordance with the present invention to operate at high power in excess of 1,000 watts. The length of the filter was approximately 2.8". From 11.7 to 12.2 GHz, the return loss is greater than 28 dB and the insertion loss over the same frequency range was less than 0.2. As can be seen from FIG. 9, the isolation is greater than 60 dB from 14 to 20.1 GHz. The filter 2 can eliminate higher order spurious modes over a predetermined frequency range. For low and medium power handling capability, the filter can be operated to ensure a spurious free response to at least the third harmonic. The filter can be operated at high power at the expense of a lower isolation in stopband regions.

However, it is possible to extend the stopband and, at the same time, have high power handling capability by inserting a dielectric material between the top-loading 22 and the interior surface 28 of the housing 4.

Figure 10:
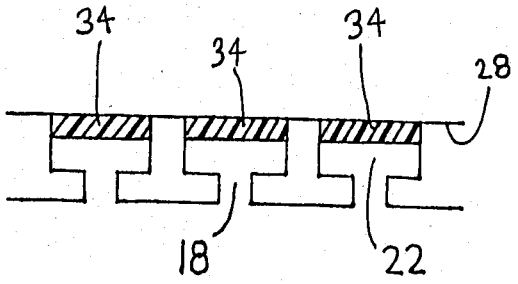
FIG. 10 is a schematic view of three top-loaded T-shaped ridges with dielectric material located between a top-loading and interior surface of the housing.
Figure 11:
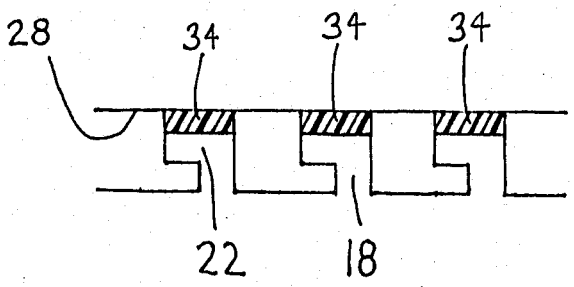
FIG. 11 is a schematic view of three top-loaded L-shaped ridges with dielectric material located between a top-loading and interior surface of the housing.

In FIG. 10, there is shown a schematic side view of three top-loaded T-shaped ridges 18 with dielectric material 34 located between a top-loading 22 and an interior surface 28 of the housing. In FIG. 11, there is shown a schematic view of three top-loaded L-shaped ridges 18 with dielectric material 34 located between a top-loading 22 of each ridge 18 and an interior surface 28 of the housing.

What I claim as my invention is:

1. A waveguide lowpass filter operating in at least two evanescent modes, said filter comprising a waveguide, with a single row of successive ridges located along a length of said waveguide, with spaces between said ridges, said ridges being associated with parallel capacitance, said spaces being associated with series inductance in one mode, each ridge having a top-loading mounted thereon so that series capacitance can occur, in another mode in parallel to said series inductance, between the top-loading on successive ridges.

2. A filter as claimed in claim 1 wherein the filter operates in $TE_{10}$ and $TM_{11}$ evanescent modes, the parallel capacitance and series inductance occurring in said $TE_{10}$ mode and the series capacitance occurring in said $TM_{11}$ mode parallel to said series inductance.

3. A filter as claimed in claim 2 wherein the top-loading on each ridge gives each ridge a T-shaped cross-section when viewed transverse to the length of said waveguide.

4. A filter as claimed in claim 2 wherein the top-loading in each ridge gives the ridge an L-shaped cross-section when viewed transverse to the length of said waveguide.

5. A filter as claimed in claim 2 wherein the top-loading on each ridge gives all the ridges located between a first ridge and a last ridge a T-shaped cross-section when viewed transverse to the length of said waveguide and a first ridge and a last ridge an L-shaped cross-section when viewed transverse to the length of said waveguide.

6. A filter as claimed in any one of claims 2, 3 or 4 wherein successive ridges are formed on a dielectric substrate metallized in a shape of the ridges with a thin layer of copper on one side thereof.

7. A filter as claimed in any one of claims 2, 3 or 4 wherein dielectric material is located between an upper surface of said top-loading and an interior surface of said waveguide for said filter, when said filter is in an upright position with said ridges extending vertically upward.

8. A filter as claimed in any one of claims 2, 3 or 4 wherein the ridges are in a straight line along the length of said waveguide.

9. A filter as claimed in any one of claims 2, 3 or 4 wherein the ridges and top-loading are formed by a fin-line technique.

10. A filter as claimed in any one of claims 2, 3 or 4 wherein successive ridges are formed on a dielectric substrate metallized in a shape of the ridges with a thin layer of copper on both sides thereof.

* * * * *